US008162619B2

(12) United States Patent
Laskaris

(10) Patent No.: US 8,162,619 B2
(45) Date of Patent: Apr. 24, 2012

(54) METHOD FOR CONTROLLING THE DISCHARGE PRESSURE OF AN ENGINE-DRIVEN PUMP

(75) Inventor: Michael A. Laskaris, Collegeville, PA (US)

(73) Assignee: Hale Products, Inc., Conshohocken, PA (US)

( * ) Notice: Subject to any disclaimer, the term of this patent is extended or adjusted under 35 U.S.C. 154(b) by 1189 days.

(21) Appl. No.: 11/464,177

(22) Filed: Aug. 11, 2006

(65) Prior Publication Data

US 2008/0292472 A1 Nov. 27, 2008

(51) Int. Cl.

| | |
|---|---|
| ***F04B 49/08*** | (2006.01) |
| ***F04B 49/03*** | (2006.01) |
| ***F04B 53/10*** | (2006.01) |
| ***F04B 17/05*** | (2006.01) |

(52) U.S. Cl. ..... 417/34; 417/26; 417/28; 417/53; 137/492.5

(58) Field of Classification Search ..... 417/34; 137/492.5

See application file for complete search history.

(56) References Cited

U.S. PATENT DOCUMENTS

| | | | | |
|---|---|---|---|---|
| 2,639,725 | A * | 5/1953 | Albright | 137/492.5 |
| 3,786,869 | A | 1/1974 | McLoughlin | |
| 4,189,005 | A | 2/1980 | McLoughlin | |
| 4,523,431 | A * | 6/1985 | Budzich | 60/431 |
| 4,653,978 | A | 3/1987 | Eberhardt et al. | |
| 4,977,925 | A * | 12/1990 | Tiefenthaler | 137/489.5 |
| 5,888,051 | A | 3/1999 | McLoughlin et al. | |
| 6,766,863 | B2 | 7/2004 | Arvidson et al. | |

FOREIGN PATENT DOCUMENTS

| | | |
|---|---|---|
| DE | 1274402 | 8/1968 |

OTHER PUBLICATIONS

Office Action issued Nov. 1, 2011 in AU Application No. 2007286213.

* cited by examiner

*Primary Examiner* — Devon Kramer
*Assistant Examiner* — Philip Stimpert
(74) *Attorney, Agent, or Firm* — Panitch Schwarze Belisario & Nadel LLP

(57) ABSTRACT

A system for controlling the pressure output of an engine-driven centrifugal fire pump includes a discharge pressure sensor mounted in the discharge line of the pump. A governor varies the rpms of the engine in response to pressure changes detected by the discharge pressure sensor. If the pressure in the system is higher than the desired output pressure when the engine is running at its idle speed an electronically controlled hydraulic relief valve responsive to the discharge pressure sensor operates to relieve the excess pressure in over pressure situations. If the pressure in the system is lower than the desired output pressure when the relief valve is fully closed, the engine speed is increased.

7 Claims, 3 Drawing Sheets

METHOD FOR CONTROLLING THE DISCHARGE PRESSURE OF AN ENGINE-DRIVEN PUMP

BACKGROUND OF THE INVENTION

This invention relates to a method for controlling the pressure output of an engine-driven pump system. Specifically, this invention relates to a method of controlling the discharge pressure of an engine-driven pump for use in a fire truck.

It is vital to control the discharge pressure of an engine-driven fire pump mounted on or in a fire truck. The pump must supply water at various rates and steady pressure so that firemen operating the hoses at a fire scene can control the reaction force generated by their hose nozzles. Fire pumps as used here are centrifugal pumps. These pumps add pressure to the incoming source of water. Therefore pressure changes in the supply are pressure changes in the discharge. This is problematic because even slight variations in pressure in the supply line leading to the intake of the pump are amplified by the pump on the discharge side, causing surges or oscillations in the water flow discharge at the nozzle and corresponding changes in the reaction forces. Such changes are extremely dangerous, as they can pull a nozzle out of the fireman's grip, or even throw him or her off a ladder or ledge.

The simplest prior art device for controlling the pressure output of the fire pump is a mechanical relief valve which opens to discharge excess water when the pressure is higher than the desired output pressure. A shortcoming of such a valve, however, is that, the relief valve only functions to dissipate excess pressure, and has no utility in situations where the pressure is too low, such as when the water source is being depleted or another hose is connected to the system. In addition, if the pump engine continues to operate at full speed after the relief valve is opened, water will be continuously recirculated in the system, resulting in needless waste and wear and tear on the pump and engine. Overheating of the pump and engine is also more likely.

Electronically operated pressure controlled systems have been developed. Two such systems are disclosed in U.S. Pat. Nos. 3,786,869 and 4,189,005 to McLoughlin, the subject matter of which is herein incorporated by reference. In these systems, the desired output pressure is dialed in or otherwise transmitted to a control box on the board of the fire truck, where it is compared to the actual output pressure as measured by a transducer. Any difference between the desired and actual output pressure is converted to an electrical signal which is fed to a DC motor which increases or decreases the rpm of the centrifugal pump as needed until the desired output pressure is reached. A shortcoming of this type of system is that, because the response time of the servo-mechanism controlling the engine is slow, much time can pass before the appropriate rpm and correct discharge pressure are reached. This is especially troublesome during transient events, such as overpressure spikes, where the system's response time is greater than the length of the event. Furthermore, no allowance is made for situations such as when the engine is already at idle and the incoming pressure suddenly increases, or is higher than desired, such as what can happen when the pump is connected to a hydrant. Recent engine technology has replaced the servo with direct commands to the engine computer or an electrical throttle control which can improve response times.

Another control system of interest is disclosed in German Patent No. 1,274,402 to Mueller and Company, which discloses an engine-driven pump which responds to an over pressure in the supply line by simultaneously opening a pressure relief valve and mechanically reducing the engine speed. The shortcoming of this purely mechanical system is that by its nature, in cases of over pressure, the relief valve will always be open to some extent, allowing some fluid to always bypass the relief valve, and the engine rpm will always be above its idle setting to a certain extent.

Another pressure control system of interest is disclosed in U.S. Pat. No. 5,888,051, which discloses an engine-driven pump which responds to an over pressure in the supply line and lowers the engine rpm and simultaneously controls a pressure relief valve which may be commanded to open and dump water for short durations to relieve over pressure spikes, or for longer duration to relieve excess water coming into the pump. The shortcomings of this system are that the change in engine speed and the relief valve may be operated at the same time resulting in a waste of water. In addition, operating the engine and relief valve simultaneously results in a needlessly complicated response system.

Accordingly, a need exists for a new and improved electronically operated fire pump discharge pressure control system for quickly and safely responding to drops or increases in the incoming pressure of a fire pump, which change the discharge pressure required, as well as changes in discharge pressure due to the opening or shutting off of various valves downstream of the pump.

BRIEF SUMMARY OF THE INVENTION

Briefly stated, the present invention is directed to a method for controlling the discharge pressure of an engine-driven centrifugal pump in a system. The system includes an engine having an idle speed Si. The engine drives the pump. An intake line is coupled to the pump for receiving a liquid. The pump has a discharge line coupled to the pump for discharging the liquid. An internal pressure sensor in the discharge line senses the actual internal pressure Pa in the discharge line. A relief valve is in the discharge line. The relief valve is movable or actuatable in a first direction away from a fully closed initial position or condition. A controller is operatively connected to the engine, the internal pressure sensor, and the relief valve for varying the speed of the engine and a position of the relief valve. The method comprises the steps of selecting a desired internal pressure Pd for the discharge line. The engine is operated to drive the pump and create pressure in the discharge line. If the actual internal pressure Pa is less than the desired internal pressure Pd the engine speed is increased while maintaining the relief valve in the fully closed position. If the actual internal pressure Pa is greater than the desired internal pressure Pd and the engine speed is greater than the idle speed Si, the engine speed is decreased while maintaining the relief valve in the fully closed position. If the actual internal pressure Pa is greater than the desired internal pressure Pd and the engine speed is equal to or less than the idle speed Si, the relief valve is opened without adjusting the speed of the engine. If the actual internal pressure Pa is less than the desired internal pressure Pd and the engine speed is less than or equal to the idle speed Si, the relief valve is maintained in a closed position. The adjustment of the relief valve and engine speed is continuously carried by repeating the foregoing steps.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
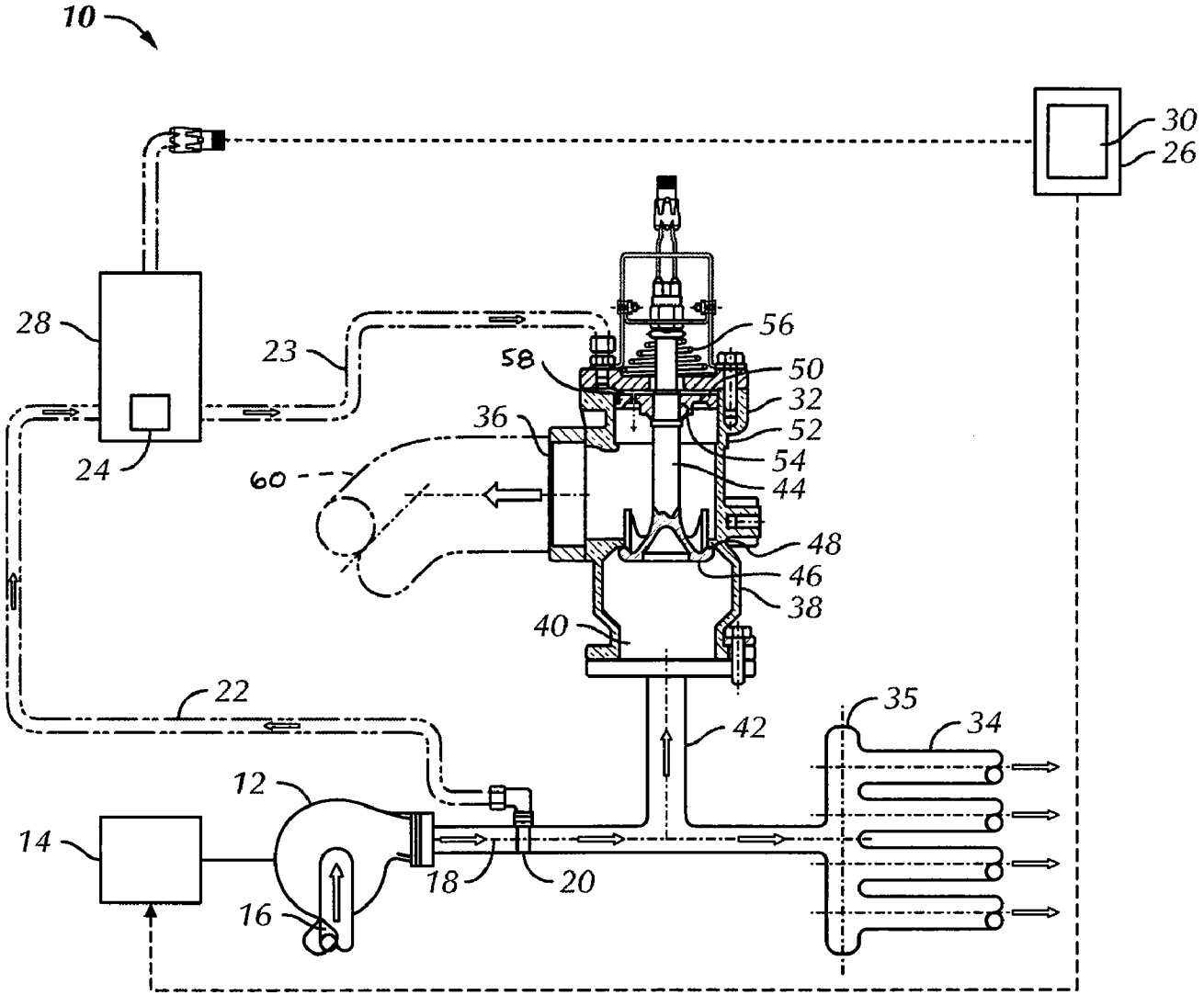
FIG. 1 is a schematic view of a preferred embodiment of a pressure controlled engine driven pump system with a relief valve in the closed position.

Certain terminology is used in the following description for convenience only and is not limiting. The words, "right", "left", "up", "down", "top", and "bottom" designate directions in the drawings to which reference is made. The words "interior" and "exterior" refer to directions toward and away from, respectively, the geometric center of the pump system or parts or portions thereof. Furthermore, as used herein, the article, "a" or singular components include the plural or more than one component, unless specifically and explicitly restricted to the singular or a singular component or unless a singular meaning is apparent from the context. The terminology includes the words above specifically mentioned, derivatives thereof and words of similar meaning.

Figure 2:
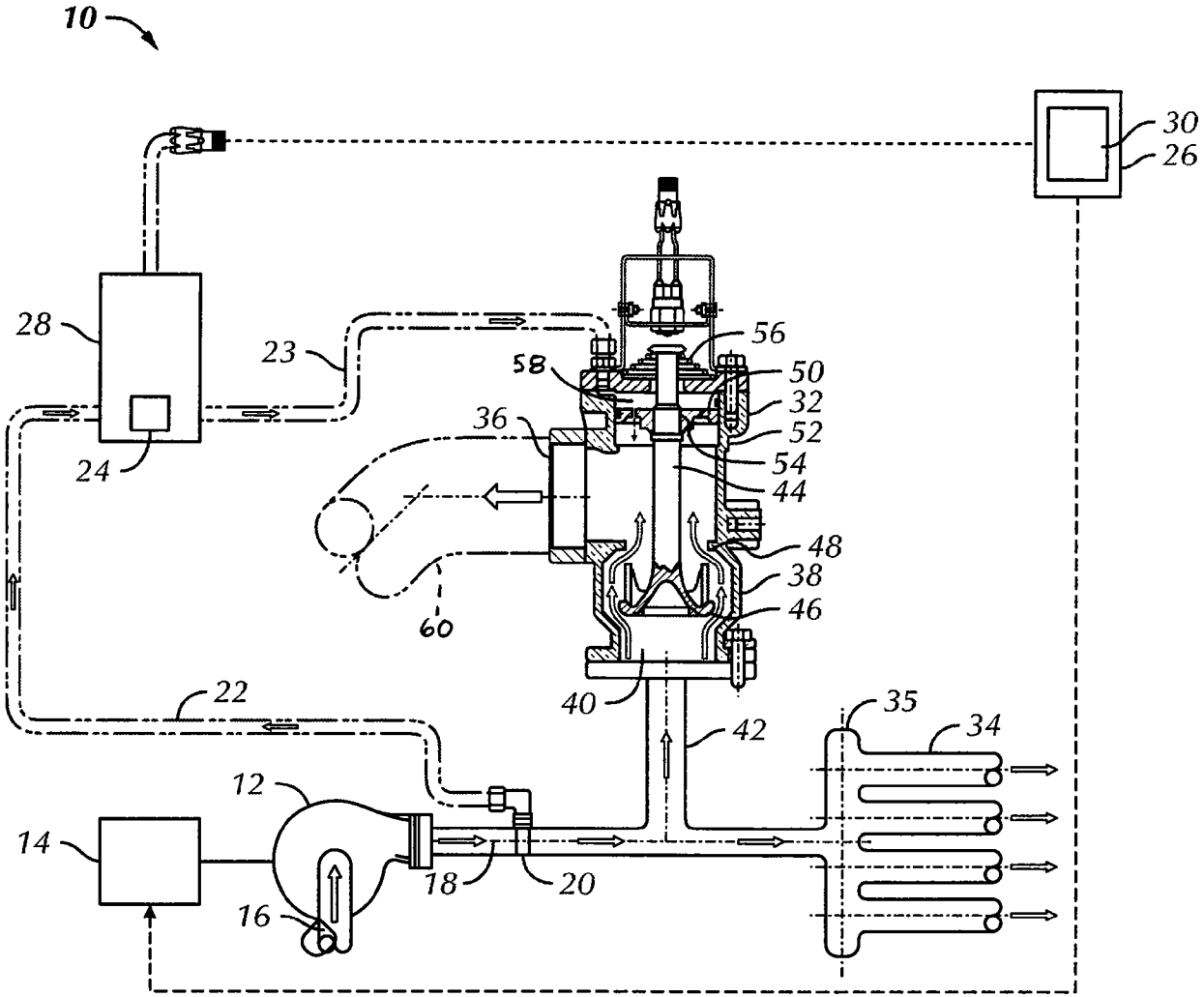
FIG. 2 is a schematic view of the preferred embodiment of the pressure controlled engine driven pump system with the relief valve in the open position.
Figure 3:
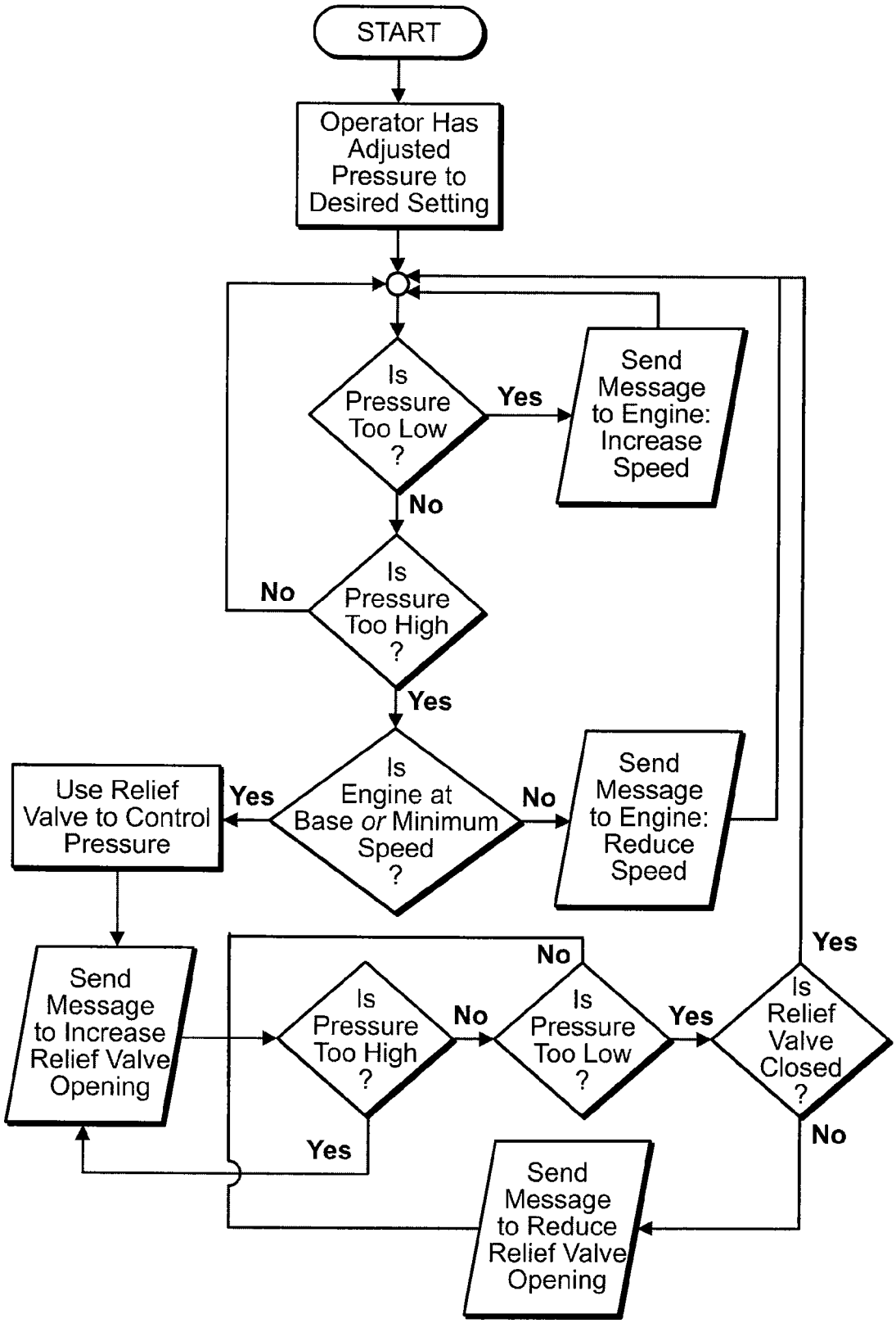
FIG. 3 is a flow chart depicting the operation of the pressure controlled engine driven pump system.

Referring to the drawings in detail, wherein like reference numerals are used to identify like components throughout, there is shown in FIGS. 1-3, the preferred embodiment of a system, generally designated 10, for controlling a discharge pressure of an engine-driven centrifugal pump 12. The pump 12 is driven by a gasoline, diesel, or electric engine 14 via a conventional power-take-off transmission (not shown). Thus, the engine 14 is preferably the same engine that drives a fire truck (not shown). However, it is understood by those skilled in the art that the pump 12 could be driven by a separate stand alone engine (not shown). When the fire truck is parked, the engine 14 has an idle RPM speed Si. The idle speed Si is preset by either the manufacturer of the fire truck, or by the system 10 set by the user. The engine idle speed Si for driving the pump 12 may be set higher or lower than the minimum or general idle speed Si of the engine Si 14 during normal driving operation of the fire truck. A higher idle speed Si may be set in order to meet the pressure needs of the system 10 in certain applications. That is, the engine 14 may have two or more idle speeds. One idle speed for when the system 10 is not in use, and an engine idle speed Si for when the system 10 is engaged.

An intake line 16 is coupled to the pump 12 for receiving a fire suppressing liquid, such as water or foam. The intake line 16 delivers liquid to the pump 12 from an external or internal water source (not shown) such as a tank of the truck, a fire hydrant, or an open body of water (not shown). A discharge line 18 is coupled to the pump 12 for discharging the pressurized liquid through a hose 34. The hose 34 is coupled to a manifold 35 to provide for a series of hoses 34 for multiple discharges from a single system 10. Alternatively, the manifold 35 may be omitted and only a single hose 34 is used.

A pencil strainer 20 is mounted on the discharge line 18 downstream of the pump 12. The pencil strainer 20 is located within the flow or perpendicular to the flow direction in the discharge line 18. The pencil strainer 20 can be any self cleaning strainer. A pilot control line 22 is connected to the discharge line 18 just downstream from the pump 12 where the pencil strainer 20 is located. The pencil strainer 20 directs some of the flow of the liquid up into the pilot control line 22. The pilot control line 22 is connected to a flow control valve 28. The pressure sensor 24 measures the actual internal pressure Pa in the discharge line 18. The pressure sensor 24 may be of any type such as a Bourdon type potentiometer, semiconductor transducer, or a strain gauge type transducer.

The pressure sensor 24 and flow control valve 20 output an electrical signal to a pressure governor 26 which represents the actual internal pressure Pa. The pressure governor 26 is also electrically coupled to the engine 14. As discussed in more detail hereinafter, the pressure governor 26 controls the position of the flow control valve 28 and the speed of the engine 14 in response to the actual internal pressure Pa in the discharge line 18 and the actual speed of the engine 14. The pressure governor 26 also controls the flow of liquid through the flow control valve 28 from the pilot control line 22 to a conduit 23 which is coupled to a relief valve 32, as described in more detail hereinafter. The pressure governor 26 has a user interface 30 with a readout of pressure, engine rpms, and system measurements. The interface 30 may display more or less readings described above and in a variety of configurations. The user interface 30 may have push buttons, knobs, or touch screens. The user interface 30 also allows the user to increase or decrease a desired internal pressure Pd for the discharge line 18. The desired internal pressure Pd may be converted into a desired output pressure Po that will vary depending on the number of hoses 34 and an estimated loss factor due to any leakage in the system 10 or length of the hoses 34. The user interface 30 may be mounted on or in the fire truck (not shown) or the end of one of the hoses 34.

An alarm or alarms (not shown) may also be incorporated to provide warnings when various problems occur, such as water shortages, high temperatures or the like. The alarm or alarms may be either visual, in the form of warning lights on the truck or the user interface 30, audible or tactile. A tactile alarm would cause the flow within a hose 34 to modulate so that a hose operator would feel the hose shaking and thus be aware of a problem.

The relief valve 32 is coupled to the conduit 23 downstream from the flow control valve 28. The relief valve 32 is also coupled to the discharge line 18 downstream from the pump 12 and pencil strainer 20. The relief valve 32 has a first position when the relief valve 32 is fully closed as depicted in FIG. 1 and a second position when the relief valve 32 is in a fully opened position as depicted in FIG. 2. The relief valve 32 has an outer housing 38 having a first open end 40 fluidly coupled to the discharge line 18 via a bypass conduit 42. A rod 44 has an expanded generally cylindrical piston 46 on its distal end which sealingly mates with a valve seat 48 within the housing 38. The proximal end of the rod 44 includes a cylindrical disk-shaped seat 50 that sealing moves along an internal cylindrical surface 52 of the housing 38. The rod 44 reciprocally extends through an aperture 54 in the housing 38. A spring 56 is located between the proximal end of the rod 44 and the outside of the housing 38 to bias the rod 44 upwardly toward the closed position with piston 46 sealed against the seat 48 to prevent fluid in the discharge line 18 from passing through the relief valve 32. The conduit 23 is coupled to the housing 38 and is in fluid communication with an expandable cylindrical area 58 between the housing 38 and the disk-shaped seat 50. When the relief valve is actuated 32, the rod 44 and piston 46 move downwardly away from the valve seat 48 against the pressure from the discharge line 18 flowing through the bypass conduit 42 to allow fluid to pass through the relief valve 32, as shown in FIG. 2. The housing 38 includes a side opening 36 coupled to an overflow conduit 60 to allow fluid to flow from the discharge line 18. The overflow conduit 60 can discharge to the source of fluid, can be coupled to the intake line 16 or can merely allow the fluid to be discharged onto the ground or other location.

The relief valve 32 is not limited the hydraulic relief valve 32. Specifically, a solenoid controlled relief valve (not shown) could be used without departing from spirit and scope of the invention. In addition, more than one relief valve may be incorporated in the system 10, such as that shown in U.S. Pat. No. 4,653,978, which is hereby incorporated by reference in its entirety.

The system 10 may also include a pump temperature sensor (not shown) which sends a signal to the pressure governor 26 when a maximum safe temperature is reached, as may happen when the pump is operating with all discharge lines 18 shut so that no water flows through the system. The pressure governor would then output a signal to a pump-to-tank valve (not shown) to discharge high temperature liquid until a safe temperature is reached.

FIG. 3 shows a flow chart indicating how the system 10 operates. In operation, a user sets the desired discharge pressure Pd on the user interface 30 of the pressure governor 26. If the actual internal pressure Pa as measured by the pressure sensor 24, is lower than the desired internal pressure Pd and the relief valve 32 is in its initially closed position then the pressure governor 26 sends a message to the engine 14 to increase its rpms above its idle speed Si. The engine speed is increased until the actual pressure Pa equals the internal pressure Pd. Once the actual internal pressure Pa exceeds the desired internal pressure Pd a message is sent to the engine 14 to reduce the speed of the engine 14. If the engine is reduced to its idling speed Si or lower and the actual internal pressure Pa is greater than the desired internal pressure Pd a message is sent to the flow control valve 28 to open the flow of liquid going through the conduit 23 to the relief valve 32. This causes the relief valve 32 to open and discharges the liquid directed from the discharge line 18 through the side opening 36 of the relief valve 32. As liquid exits the relief valve 32 the actual internal pressure Pa in the discharge line 18 is reduced. The relief valve 32 remains open until the actual internal pressure Pa is less than the desired internal pressure Pd. If the actual internal pressure Pa drops below the desired internal pressure Pd a message from the pressure governor 26 is sent to the flow control valve 28 to allow liquid in conduit 23 to bleed out of the line causing the relief valve 32 to close. Once the relief valve 32 is closed, if the actual internal pressure Pa remains less than the desired internal pressure Pd a message is sent from the pressure governor 26 to the engine 14 to increase the engine speed. This system continues until the user turns off the system 10. It is noted that the relief valve 32 is never open when the engine 14 is running above its idle speed Si. In addition, the relief valve 32 is fully closed before the engine 14 speed is increased. Additionally, the relief valve 32 remains closed until the engine 14 is returned to its idle speed Si. Because electronic engines respond faster than previous engines used in fire trucks, there is no need to operate the relief valve unless the engine is at idle speed and the pressure is too high.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A method for controlling the discharge pressure of an engine-driven centrifugal pump in a system including the engine having an idle speed Si, the pump being driven by the engine, an intake line coupled to the pump for receiving a liquid, a discharge line coupled to the pump for discharging the liquid, a pencil strainer mounted on the discharge line, a pilot control line connected to the discharge line at the pencil strainer, the pencil strainer directing liquid from the discharge line into the pilot control line, an internal pressure sensor in the pilot control line sensing an actual internal pressure Pa in the discharge line, a conduit downstream of the internal pressure sensor, a relief valve in the discharge line and coupled to the conduit, the relief valve being actuatable in a first direction away from a fully closed initial condition, the internal pressure sensor being located upstream of the relief valve, and a controller operatively connected to the engine, the internal pressure sensor and the relief valve, for varying a speed of the engine, and a condition of the relief valve, the method comprising the steps of:

a) selecting a desired internal pressure Pd for the discharge line;

b) operating the engine to drive the pump and generate pressure in the discharge line, c) increasing engine speed if Pa<Pd while maintaining the relief valve in the fully closed initial condition;

d) decreasing engine speed if Pa>Pd and the engine speed is greater than Si, while maintaining the relief valve in the fully closed condition;

e) opening the relief valve if Pa>Pd and the engine speed is equal to or less than Si without adjusting the engine speed; and f) closing the relief valve if Pa<Pd and the engine speed is less than or equal to Si; and g) repeating steps c) through f).

2. The method of claim 1, further comprising the step of e1) maintaining the relief valve in an open condition until Pa<Pd.

3. The method of claim 1, wherein the relief valve has an outer housing and a rod with a piston on a distal end thereof that sealingly mates with a valve seat within the housing, the housing including a first open end fluidly coupled to the discharge line via a bypass conduit and a side opening coupled to an overflow conduit to allow liquid to flow from the discharge line, a spring being located between a proximal end of the rod and an outside of the housing to bias the rod upwardly toward a fully closed initial condition.

4. A method for controlling the discharge pressure of an engine-driven centrifugal pump in a system including the engine having an idle speed Si, the pump being driven by the engine, an intake line coupled to the pump for receiving a liquid, a discharge line coupled to the pump for discharging the liquid, an internal pressure sensor in the discharge line sensing an actual internal pressure Pa in the discharge line, a relief valve in the discharge line, the relief valve being actuatable in a first direction away from a fully closed initial condition, the relief valve having an outer housing and a rod with a piston on a distal end thereof that sealingly mates with a valve seat within the housing, the housing including a first open end fluidly coupled to the discharge line via a bypass conduit and a side opening coupled to an overflow conduit to allow liquid to flow from the discharge line, a spring acting to bias the rod upwardly toward the fully closed initial condition, a seat located between the spring and the piston which receives pressure to move the rod downwardly away from the fully closed initial condition, and a controller operatively connected to the engine, the internal pressure sensor and the relief valve, for varying a speed of the engine, and a condition of the relief valve, the method comprising the steps of:

a) selecting a desired internal pressure Pd for the discharge line;

b) operating the engine to drive the pump and generate pressure in the discharge line and operating the engine above the idle speed Si only when the relief valve is in the fully closed initial condition;

c) increasing engine speed if Pa<Pd while maintaining the relief valve in the fully closed initial condition;

d) decreasing engine speed if Pa>Pd and the engine speed is greater than Si, while maintaining the relief valve in the fully closed condition;

e) opening the relief valve if Pa>Pd and the engine speed is equal to or less than Si without adjusting the engine speed; and f) closing the relief valve if Pa<Pd and the engine speed is less than or equal to Si; and g) repeating steps c) through f).

5. The method of claim 4, wherein the system further includes:

a pencil strainer mounted on the discharge line, a pilot control line connected to the discharge line at the pencil strainer, the pencil strainer directing liquid from the discharge line into the pilot control line, the internal pressure sensor in the pilot control line sensing an actual internal pressure Pa in the discharge line, a conduit downstream of the internal pressure sensor, and the relief valve coupled to the conduit.

6. A method for controlling the discharge pressure of an engine-driven centrifugal pump in a system including the engine having an idle speed Si, the pump being driven by the engine, an intake line coupled to the pump for receiving a liquid, a discharge line coupled to the pump for discharging the liquid, a pencil strainer mounted on the discharge line, a pilot control line connected to the discharge line at the pencil strainer, the pencil strainer directing liquid from the discharge line into the pilot control line, an internal pressure sensor in the pilot control line sensing an actual internal pressure Pa in the discharge line, a conduit downstream of the internal pressure sensor, a relief valve coupled to the conduit, the relief valve being actuatable in a first direction away from a fully closed initial condition, wherein the first direction is away from a valve seat against the pressure from the discharge line flowing through a bypass conduit to allow liquid to pass through the relief valve, and a controller operatively connected to the engine, the internal pressure sensor and the relief valve, for varying a speed of the engine, and a condition of the relief valve, the method comprising the steps of:

a) selecting a desired internal pressure Pd for the discharge line;

b) operating the engine to drive the pump and generate pressure in the discharge line;

c) increasing engine speed if Pa<Pd while maintaining the relief valve in the fully closed initial condition;

d) decreasing engine speed if Pa>Pd and the engine speed is greater than Si, while maintaining the relief valve in the fully closed condition;

e) opening the relief valve if Pa>Pd and the engine speed is equal to or less than Si without adjusting the engine speed; and f) closing the relief valve if Pa<Pd and the engine speed is less than or equal to Si; and g) repeating steps c) through f).

7. The method of claim 6, wherein the relief valve has an outer housing and a rod with a piston on a distal end thereof that sealingly mates with a valve seat within the housing, the housing including a first open end fluidly coupled to the discharge line via a bypass conduit and a side opening coupled to an overflow conduit to allow liquid to flow from the discharge line, a spring being located between a proximal end of the rod and an outside of the housing to bias the rod upwardly toward a fully closed initial condition.

* * * * *